US007766321B2

(12) United States Patent
Wada

(10) Patent No.: US 7,766,321 B2
(45) Date of Patent: Aug. 3, 2010

(54) SHEET LOADING APPARATUS AND RECORDING APPARATUS

(75) Inventor: Toshihide Wada, Yokohama (JP)

(73) Assignee: Canon Kabushiki Kaisha (JP)

( * ) Notice: Subject to any disclaimer, the term of this patent is extended or adjusted under 35 U.S.C. 154(b) by 151 days.

(21) Appl. No.: 11/273,675

(22) Filed: Nov. 14, 2005

(65) Prior Publication Data

US 2006/0182450 A1 Aug. 17, 2006

(30) Foreign Application Priority Data

Nov. 12, 2004 (JP) ..... 2004-328674

(51) Int. Cl.
*B65H 1/00* (2006.01)

(52) U.S. Cl. ..... 271/171

(58) Field of Classification Search ..... 271/171; 399/393

See application file for complete search history.

(56) References Cited

U.S. PATENT DOCUMENTS

| | | | | | |
|---|---|---|---|---|---|
| 5,199,695 | A * | 4/1993 | Nakahata et al. | ..... | 271/9.12 |
| 5,713,570 | A * | 2/1998 | Ouchi | ..... | 271/242 |
| 5,931,456 | A * | 8/1999 | Laidlaw | ..... | 271/171 |
| 6,116,591 | A * | 9/2000 | Kim | ..... | 271/171 |
| 6,267,522 | B1 * | 7/2001 | Slippy et al. | ..... | 400/708.1 |
| 6,536,968 | B2 * | 3/2003 | Lee et al. | ..... | 400/624 |
| 7,134,657 | B2 * | 11/2006 | Yanagi et al. | ..... | 271/171 |
| 2004/0036208 | A1 * | 2/2004 | Yanagi et al. | ..... | 271/171 |
| 2005/0062218 | A1 * | 3/2005 | Murakami et al. | ..... | 271/171 |
| 2006/0113723 | A1 * | 6/2006 | Ito et al. | ..... | 271/162 |

FOREIGN PATENT DOCUMENTS

| | | | |
|---|---|---|---|
| JP | 01209227 | A * | 8/1989 |
| JP | 06009067 | A * | 1/1994 |
| JP | 06032468 | A * | 2/1994 |
| JP | 2002-255358 | A | 9/2002 |
| JP | 2006008351 | A * | 1/2006 |

* cited by examiner

*Primary Examiner*—Patrick Mackey
*Assistant Examiner*—Michael C McCullough
(74) *Attorney, Agent, or Firm*—Rossi, Kimms & McDowell LLP

(57) ABSTRACT

A sheet loading apparatus, which is equipped with a position adjustment unit that can be held in a fixed condition with a small applying force and released from the fixed condition by an intuitive and slight operation, is provided. The apparatus includes a sheet loading unit on which sheets are loaded, a position adjustment unit that can be moved in a direction that intersects with a direction in which the sheets loaded on the sheet loading unit are conveyed, and a fixation member for fixing the position adjustment unit to the sheet loading unit. The fixation member has a connection unit for connecting to the position adjustment means at a position distant from a sheet loading surface of the sheet loading unit and a fixation member-side fixation unit that is engaged with a loading-side fixation surface formed at a position close to the sheet loading surface of the sheet loading unit. A distance between the connection unit and the fixation member-side fixation unit is longer than a minimum distance between the connection unit and the loading-side fixation surface, and the fixation member-side fixation unit is arranged on the side opposite to the sheets to be adjusted with respect to the connection unit.

8 Claims, 5 Drawing Sheets

(a)

(b)

SHEET LOADING APPARATUS AND RECORDING APPARATUS

BACKGROUND OF THE INVENTION

1. Field of the Invention

The present invention relates to a sheet loading apparatus subject to aligning in loading by a user and a recording apparatus equipped with the same.

2. Description of the Related Art

Conventionally, in most cases, a recording apparatus is equipped therein with a feeder for supplying sheets to the recording apparatus automatically. The feeder is equipped with a sheet loading apparatus for loading a plurality of sheets thereon so that these loaded sheets are supplied one by one according to a command from the side of the recording apparatus.

To maintain feed performance of the feeder, it is necessary to securely hold the loaded sheets to a proper position in the sheet loading apparatus by using a position adjustment means. The position adjustment means may employ a structure disclosed in Japanese Patent Application Laid-Open No. 2002-255358.

FIG. 5 is a schematic cross-sectional view of a sheet loading apparatus according to a conventional embodiment. A sheet loading apparatus 600 is loaded with sheets P on its sheet loading surface 601. This sheet loading apparatus 600 includes a position adjustment unit 610 that can move in a direction perpendicular to a sheet conveyance direction. The position adjustment unit 610 true up sides of the sheets P by pressing and moving the loaded sheet bundle in a direction of an arrow 5. A reaction force from the sheets P, which acts on the position adjustment unit 610 in a direction of an arrow 5*a*, is taken by a latch unit 611 of the position adjustment unit 610 because this latch unit is engaged with a serration 602 formed on the sheet loading apparatus 600. To release adjustment, an operation panel 612 of the position adjustment unit 610 is operated (pressed) in the direction of the arrow 5*a* to swing the latch unit 611 around a connection unit 613 so that the latch unit 611 is separated from the serration 602 and is released fixation. A spring 614 applies a force to the operation panel 612 to apply a force to the latch unit 611 on the serration 602 to add a tension so that the latch unit 611 may mesh with the serration surely. Further, an elastic force of the connection unit 613, which is formed integrally with the position adjustment unit 610, also adds a tension to apply a force to the latch portion 611 on the serration 602.

However, in this configuration of the conventional embodiment, fixation of the position adjustment unit 610 to the sheet loading apparatus 600 is secured through a shearing force or friction of a latch form by applying a force to the latch unit 611 on the serration 602. Therefore, if a position resolution of a fixation portion is enhanced, a tally margin for the latch form decreases, and a holding force is reduced problematically. If a force applied to the latch unit is increased to enhance the holding force, on the other hand, a user needs more power in operation, and operational feeling is deteriorated problematically. Additionally, to improve the operational feeling, recently there has been a strong demand for a mechanism to allow a user to operate with slight force by an intuitive operation.

SUMMARY OF THE INVENTION

It is an object of the present invention to provide a sheet loading apparatus equipped with a position adjustment means that can be held in a fixed condition with a small applying force and released from the fixed condition by an intuitive and slight operation.

DETAILED DESCRIPTION OF THE PREFERRED EMBODIMENTS

Figure 1:
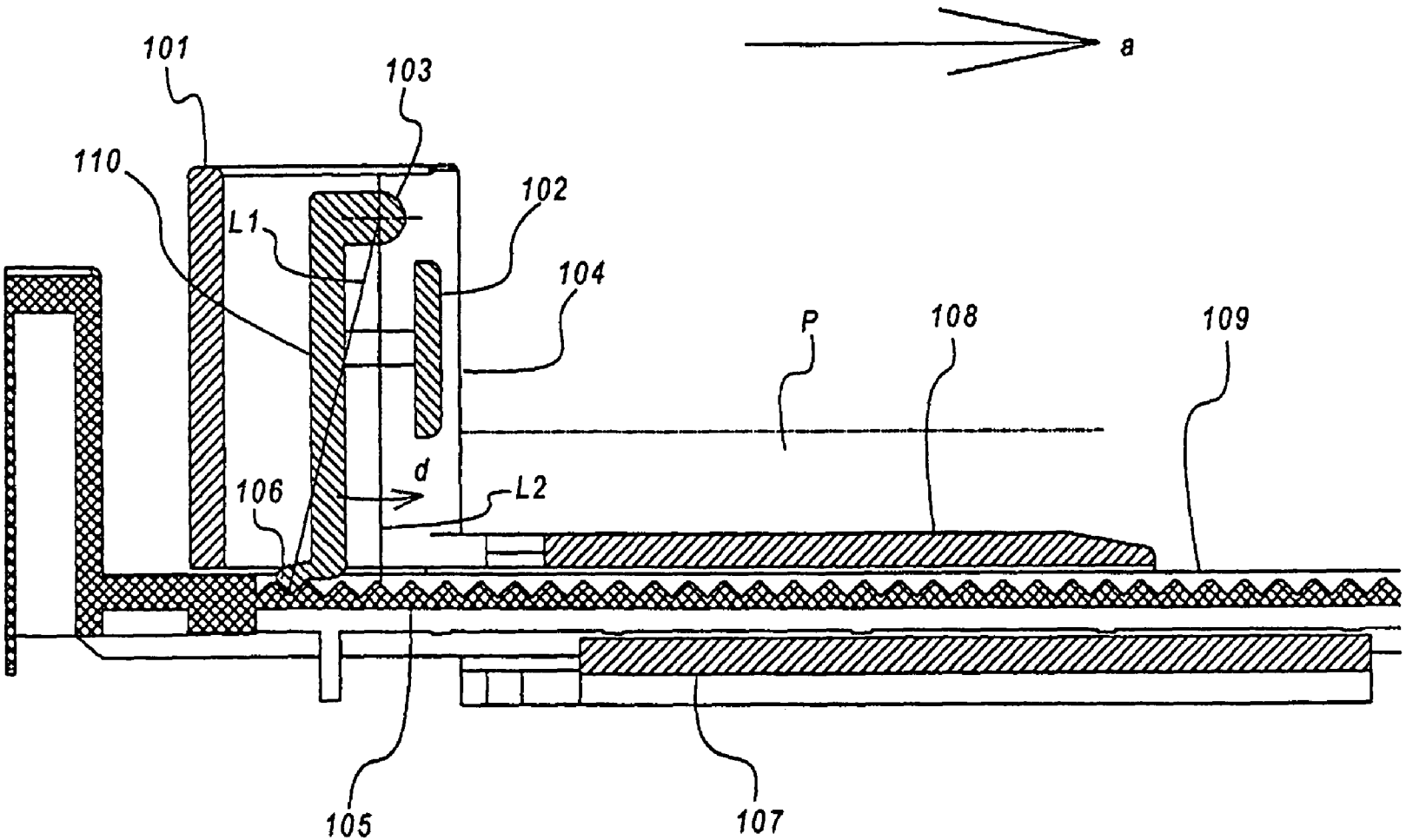
FIG. 1 is a cross-sectional view of a substantial part of a sheet loading apparatus.
Figure 2:
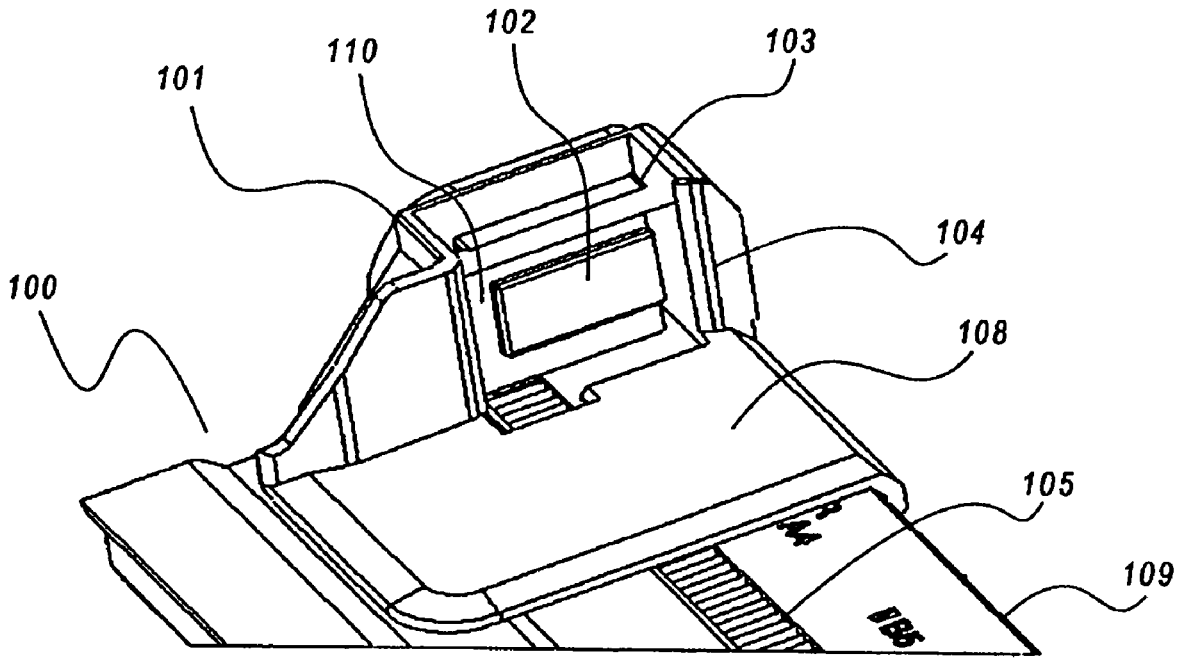
FIGS. 2A and 2B are perspective views of the substantial part of the sheet loading apparatus.
Figure 2:
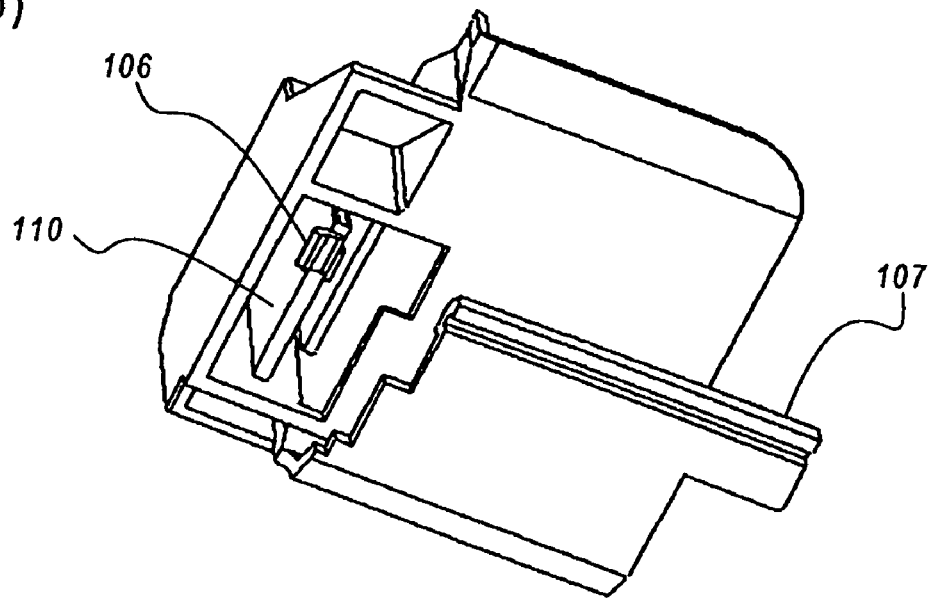
Figure 3:
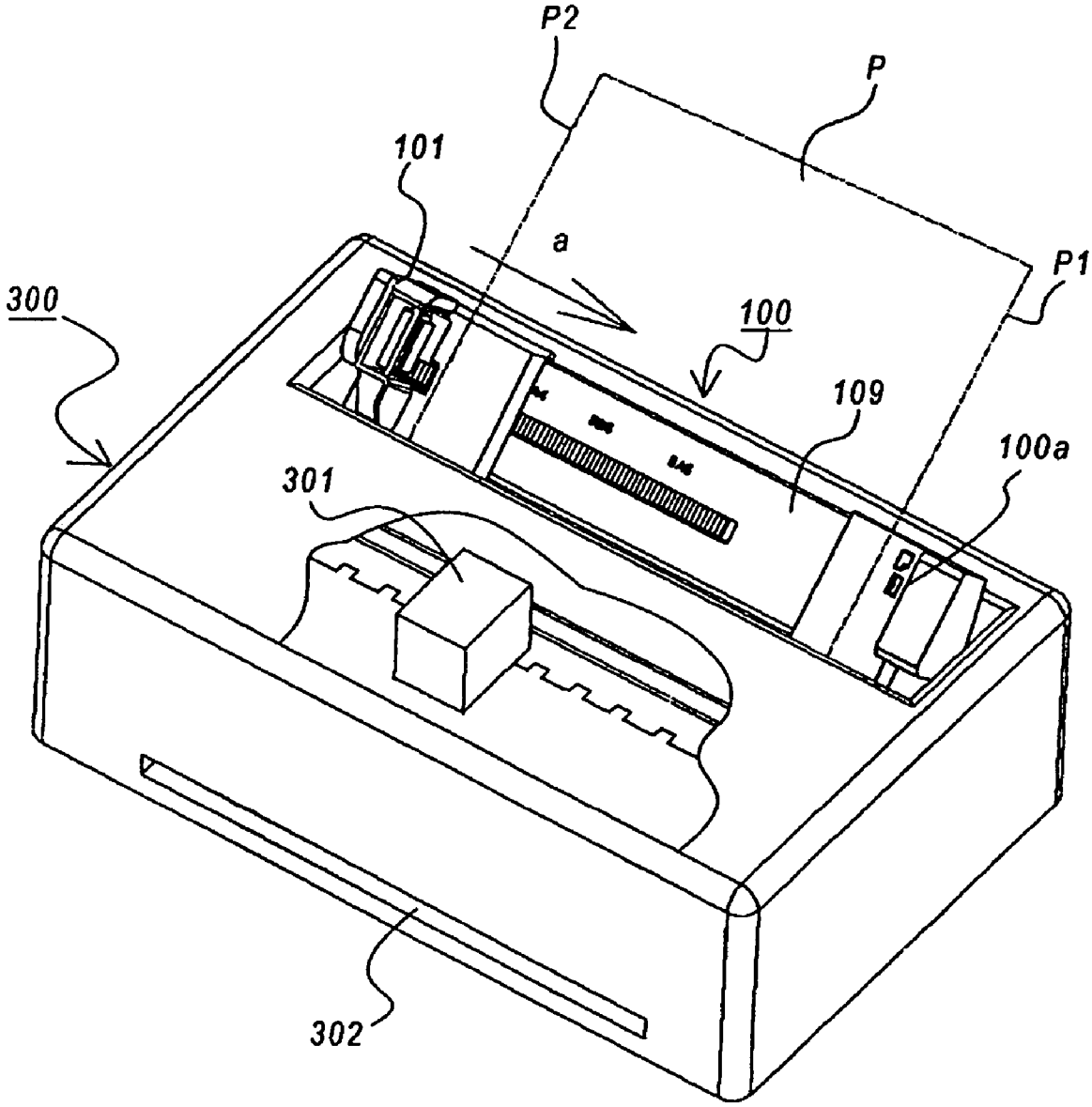
FIG. 3 is a schematic external view of a recording apparatus equipped with the sheet loading apparatus.

The following will describe embodiments of a sheet loading apparatus and a recording apparatus according to the present invention. FIG. 1 is a cross-sectional view of a substantial part of the sheet loading apparatus, FIGS. 2A and 2B are perspective views of the substantial part of the sheet loading apparatus, FIG. 3 is a schematic external view of a recording apparatus equipped with the sheet loading apparatus, and FIGS. 4A to 4C are explanatory diagrams of operations of the sheet loading apparatus.

First, an overall configuration of the recording apparatus is described with reference to FIG. 3. As shown in FIG. 3, a recording apparatus 300 includes a sheet loading apparatus 100, a feeder and a conveyance apparatus not shown, a recording head 301 as an example of an image recording means, and a discharge opening 302. The sheets P loaded on a sheet loading unit 109 of the sheet loading apparatus 100 are separated from each other and fed one by one by the feeder not shown. Then, the recording apparatus 300 conveys the sheets as recording an image on them by the recording head 301 and discharges them through the discharge opening 302.

The sheet loading apparatus 100 includes a position adjustment unit 101 as a position adjustment means. The position adjustment unit 101 can be moved in a direction that intersects with a direction in which the sheets P loaded on the sheet loading apparatus 100 are conveyed (direction of an arrow a), and adjust end faces of the sheets P loaded on the sheet loading unit 109 so that they may be aligned. The positions of the sheets P are adjusted in the sheet loading apparatus 100 because these sheets are always required to be at the same position so that a recording position may be constant and performance of the feeder may be maintained. The sheets can be aligned securely by true-up sheet end faces P1 at a right-side reference 100*a* in the sheet loading apparatus 100 and can be locked by pressing sheet end faces P2 with the position adjustment unit 101.

As shown in FIG. 1, the position adjustment unit 101, which has a guide 108 (see FIG. 2A) arranged on the side of a loading surface of the sheet loading unit 109 and a guide 107 (see FIG. 2B) arranged on the back side of the loading surface, is mounted in such a manner as to sandwich the sheet loading unit 109 and configured so as to be movable in the direction that intersects with the conveyance direction of the sheets P. The position adjustment unit 101 further includes a reception surface 104 that abuts against the sheets P.

The position adjustment unit 101 is further equipped with a fixation member 110 that moves and fixes it. The fixation member 110 includes a connection unit 103 for connecting to the position adjustment unit 101 at a position (upper part in the figure) distant from the sheet loading surface of the sheet loading unit 109. And the fixation member 110 also includes a fixation member-side fixation unit 106 that is engaged with a loading-side fixation surface 105 formed at a position close to the sheet loading surface of the sheet loading unit 109. The connection unit 103 can be connected to the position adjustment unit 101 in any way to allow the fixation member 110 to swing. For example, the connection unit 103 may have its rotary shaft tallied or may be connected using an elastic member (twist-deformation).

The fixation member-side fixation unit 106 and the loading-side fixation surface 105 have irregularities in shape that are engaged with each other, and the loading-side fixation surface 105 has a lot of irregularities in a direction in which the position adjustment unit 101 moves. Specifically, the fixation member-side fixation unit 106 has a V-shaped cross-sectional rib at its tip and the loading-side fixation surface 105 has a cross section that has a lot of V-shaped grooves in configuration.

A distance L1 between the connection unit 103 and the fixation member-side fixation unit 106 is established to be longer than a minimum distance L2 between the connection unit 103 and the loading-side fixation surface 105 (L1>L2). That is, the fixation member-side fixation unit 106 is not on a perpendicular line from the connection unit 103 to the loading-side fixation surface and arranged as shifted to an opposite side of sheets to be adjusted, with respect to the connection unit 103.

Therefore, when the fixation member 110 swings around the connection unit 103, the fixation member-side fixation unit 106 moves in a direction disjunctive from the loading-side fixation surface 105. In a normal state, the fixation member-side fixation unit 106 is in contact with the loading-side fixation surface 105 slightly. Accordingly, if the rotary shaft of the connection unit 103 is tallied, its gravity can be utilized, and if the connection unit 103 is made of an elastic material, its elasticity can be utilized.

The fixation member 110 further includes an operational portion 102 between the connection unit 103 and the fixation member-side fixation unit 106 and on the side of sheets to be adjusted. The operational portion 102 can be pressed by a user to release fixation. The operational portion 102 is arranged inner than the reception surface 104 (opposite side of sheets to be adjusted) as shown in FIG. 1 but exposed as shown in FIG. 2A so that it can be touched from an outside. Therefore, the user can easily press the operation portion 102 to swing the fixation member 110.

Figure 4:
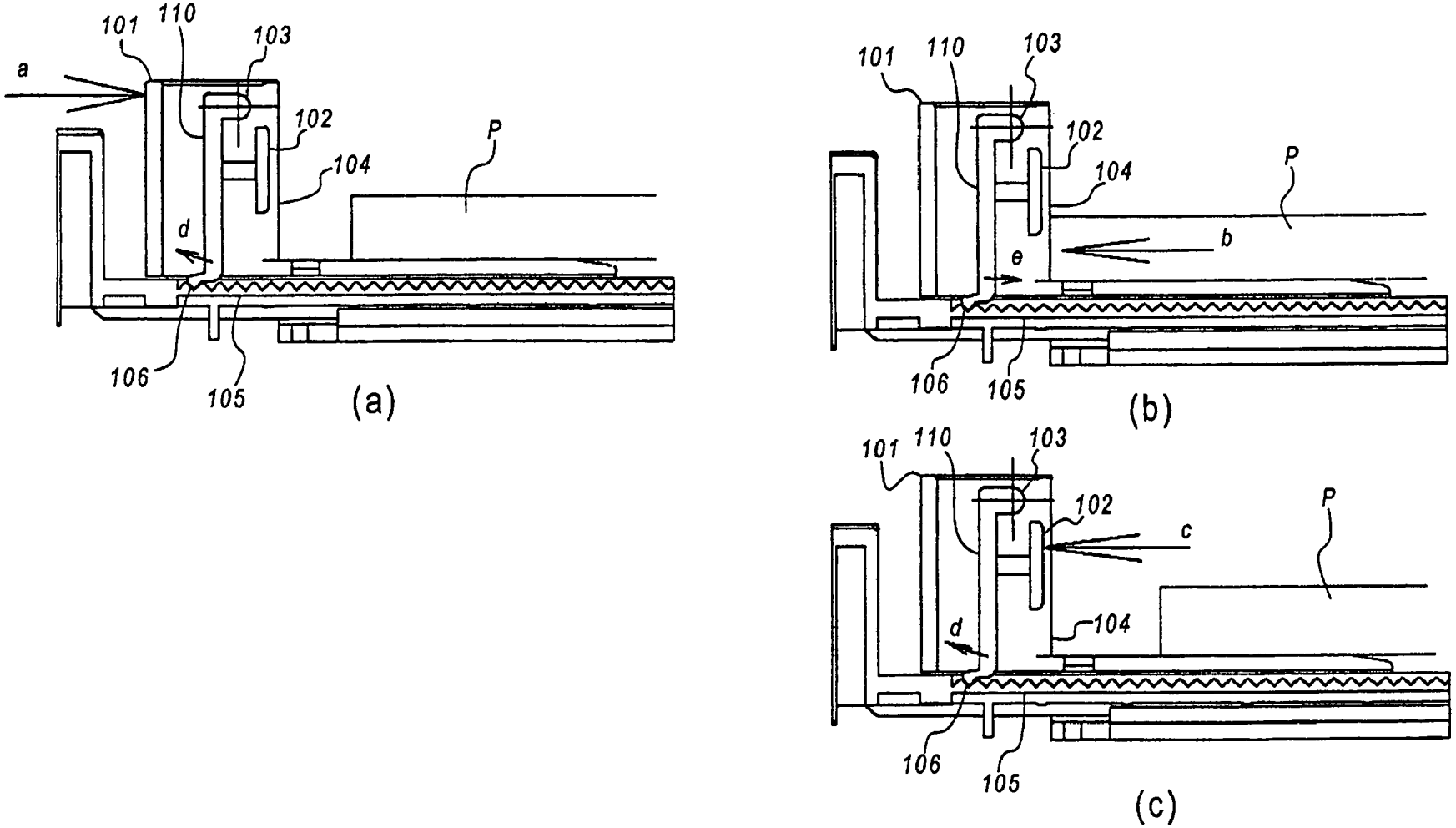
FIGS. 4A to 4C are explanatory diagrams of operations of the sheet loading apparatus.
Figure 5:
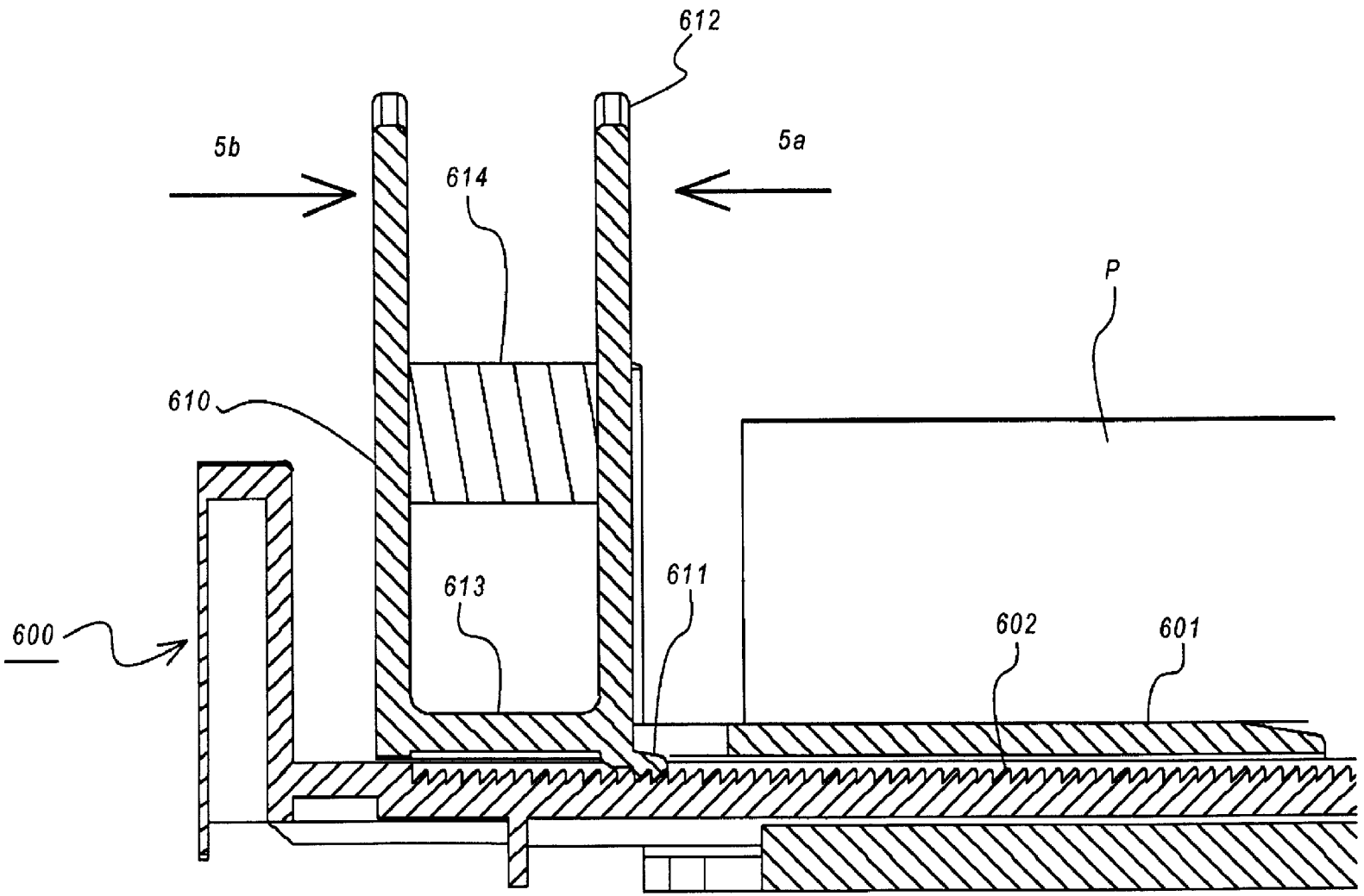
FIG. 5 (PRIOR ART)
FIG. 5 is a schematic cross-sectional view of a sheet loading apparatus according to a conventional embodiment.

The following will describe operations of the position adjustment unit 110 in the above-described configuration with reference to FIG. 4.

(a) Aligning Sheets to Adjustment Position

The operations are described with reference to a schematic operation diagram FIG. 4A. When the sheet loading unit 109 is loaded with the sheets P, the user moves the position adjustment unit 101 toward the sheets (in the direction of the arrow a). When the position adjustment unit 101 moves, the fixation member 110 cannot resist it and swings around the connection unit 103 in a direction of an arrow d. Then, the fixation member-side fixation unit 106 is disengaged from the loading-side fixation surface 105 (specifically, intermittently engaged and swung repeatedly), so that the position adjustment unit 101 can be moved with a slight force.

(b) Maintaining Adjustment Position of Sheets

The operations are described with reference to a schematic operation diagram FIG. 4B. When the loaded sheets P are being fed one by one to the side of the recording head 301, such a force is applied to the loaded sheets P as to disturb alignment of these sheets and a force is applied also to the reception surface 104 of the position adjustment unit 101 in a direction apart from the sheets (direction of an arrow b). In this case, when the position adjustment unit 101 would move in the direction of the arrow b, the connection unit 103 of the fixation member 110 would also move. Although the fixation member 110 would swing in a direction of an arrow e because the fixation member-side fixation unit 106 of the fixation member 110 is engaged with the loading-side fixation surface 105, it cannot do so owing to the above-described relationship of L1>L2. That is, the fixation member 110 acts as a support to inhibit the movement of the position adjustment unit 101, thereby the sheets P are maintained.

(c) Releasing Adjustment of Sheets

The operations are described with reference to a schematic operation diagram FIG. 4C. To release positional fixation of the position adjustment unit 101, a user of the recording apparatus presses the operational portion 102 in a direction apart from the sheets (direction of an arrow c). Then, the fixation member 110 swings around the connection unit 103 in the direction of the arrow d, so that the fixation member-side fixation unit 106 and the loading-side fixation surface 105 are unlatched from each other. Accordingly, the position adjustment unit 101 can be moved with a slight force.

As described above, in both cases of operations (a) and (c) by a user, a force is applied in a direction to which the user desires to move the position adjustment unit 101. Therefore, the user can intuitively operate the apparatus without hesitation.

The above embodiment has been described on the assumption that the fixation member-side fixation unit 106 and the loading-side fixation surface 105 have irregularities in shape that are engaged with each other. However, the present invention is not limited to it; such members may be combined as to abut against each other so that a high friction may be generated.

Although the ink-jet recording head 301 is employed and explained as an example of the image recording means in FIG. 3, the present invention is not limited to it; the present invention can be applied also to a line ink-jet recording means or multi-purpose tray of a copying machine. Further, the sheet loading apparatus according to the present invention can be applied not only to a recording apparatus but also to an automatic sheet feeder (ASF or ADF) of an image reader, a feeder of a sheet processing apparatus that executes processing, for example, staples sheets.

According to the embodiment of the present invention, since a relationship of the distance between the connection unit and the fixation member-side fixation unit being larger than the minimum distance between the connection unit and the loading-side fixation surface is established, the fixation member acts as a support if the position adjustment unit receives a reaction force from the sheets, so that the position adjustment unit can be held as fixed. Therefore, it need not a large applying force to be held as fixed and also can be released from the fixed condition with a slight operation.

CROSS-REFERENCE TO RELATED APPLICATION

This application claims the benefit of priority from the prior Japanese Patent Application No. 2004-328674 filed on Nov. 12, 2004 the entire contents of which are incorporated by reference herein.

What is claimed is:

1. A sheet loading apparatus comprising:

a sheet loading unit having V-shaped cross-sectional grooves on which sheets are loaded;

a position adjustment unit which is movable on the sheet loading unit and regulate a position of sheets stacked on the sheet loading unit;

a fixation member which is rotatably fixed to the position adjustment unit and has a V-shaped rib for engaging with the V-shaped cross-sectional grooves of the sheet loading unit, the V-shaped rib being disposed on a lateral side opposite to the sheets loaded on the sheet loading unit so that a rotational axis of the fixation member is positioned between the V-shaped rib and the sheets loaded on the sheet loading unit relative to a moving direction of the position adjustment unit; and an operational portion disposed on a side of the fixation member facing the sheets between the rotational axis and the V-shaped rib for releasing connection between the V-shaped rib and the V-shaped cross-sectional grooves, wherein the position adjustment unit is movable along a first direction, and the rotational axis of the fixation member extends perpendicular to the first direction, wherein when a force is applied to the position adjustment unit in the first direction away from the sheets, the force acts on the fixation member to urge the V-shaped rib to one of the V-shaped cross-sectional grooves, and wherein the operational portion is configured to release connection between the V-shaped rib and the V-shaped cross-sectional grooves when the operational portion is pushed along the first direction away from the sheets.

2. The sheet loading apparatus according to claim 1, wherein the fixation member is elastically deformable to the position adjustment unit.

3. The sheet loading apparatus according to claim 1, wherein the V-shaped cross-sectional grooves are arranged along the first direction.

4. The sheet loading apparatus according to claim 1, wherein a distance between the rotational axis of the fixation member and the V-shaped rib is longer than a minimum distance between the rotational axis of the fixation member and the V-shaped cross-sectional grooves.

5. A recording apparatus for recording on sheets with a recording head, the apparatus comprising:

a sheet loading unit having V-shaped cross-sectional grooves on which sheets are loaded;

a position adjustment unit which is movable on the sheet loading unit and regulate a position of sheets stacked on the sheet loading unit;

a fixation member which is rotatably fixed to the position adjustment unit and has a V-shaped rib for engaging with the V-shaped cross-sectional grooves of the sheet loading unit, the V-shaped rib being disposed on a lateral side opposite to the sheets loaded on the sheet loading unit so that a rotational axis of the fixation member is positioned between the V-shaped rib and the sheets loaded on the sheet loading unit relative to a moving direction of the position adjustment unit; and an operational portion disposed on a side of the fixation member facing the sheets, between the rotational axis and the V-shaped rib for releasing connection between the V-shaped rib and the V-shaped cross-sectional grooves, wherein the position adjustment unit is movable along a first direction, and the rotational axis of the fixation member extends perpendicular to the first direction, wherein when a force is applied to the position adjustment unit in the first direction away from the sheets, the force acts on the fixation member to urge the V-shaped rib to one of the V-shaped cross-sectional grooves, and wherein the operational portion is configured to release connection between the V-shaped rib and the V-shaped cross-sectional grooves when the operational portion is pushed along the first direction away from the sheets.

6. The recording apparatus according to claim 5, wherein the fixation member is elastically deformable to the position adjustment unit.

7. The recording apparatus according to claim 5, wherein the V-shaped cross-sectional grooves are arranged along the first direction.

8. The recording apparatus according to claim 5, wherein a distance between the rotational axis of the fixation member and the V-shaped rib is longer than a minimum distance between the rotational axis of the fixation member and the V-shaped cross-sectional grooves.

* * * * *